US005647132A

United States Patent [19]

Berns

[11] Patent Number: 5,647,132

[45] Date of Patent: Jul. 15, 1997

[54] DEBURRING KNIFE WITH REPLACEABLE BLADE

[75] Inventor: Harald Berns, Wuppertal, Germany

[73] Assignee: Martor-Argentax E.H. Beermann KG, Solingen, Germany

[21] Appl. No.: 539,766

[22] Filed: Oct. 5, 1995

[30] Foreign Application Priority Data

Oct. 7, 1994 [DE] Germany ..... 44 35 807.5

[51] Int. Cl.[6] ..... B26B 5/00

[52] U.S. Cl. ..... 30/337; 30/329; 30/125; 451/557

[58] Field of Search ..... 30/329, 337–339, 30/340, 335, 336, 162, 125; 606/167; 451/557

[56] References Cited

U.S. PATENT DOCUMENTS

| | | | |
|---|---|---|---|
| 1,861,363 | 5/1932 | Scheuner | 30/337 X |
| 3,439,419 | 4/1969 | Fleming . | |
| 4,748,743 | 6/1988 | Anderson . | |

FOREIGN PATENT DOCUMENTS

| | | | |
|---|---|---|---|
| 48077 | 3/1982 | European Pat. Off. . | |
| 2352641 | 12/1977 | France . | |
| 2716861 | 11/1977 | Germany . | |
| 3740036 | 6/1989 | Germany . | |
| 37 40 036 C2 | 10/1989 | Germany . | |
| 44 35 807 C1 | 5/1995 | Germany . | |
| 292879 | 6/1928 | United Kingdom | 30/339 |
| 415606 | 8/1934 | United Kingdom | 30/337 |

*Primary Examiner*—Douglas D. Watts
*Attorney, Agent, or Firm*—Herbert Dubno; Andrew Wilford

[57] ABSTRACT

A knife has an elongated body having a front end formed with a forwardly projecting trapezoidal-section tongue having a pair of side surfaces and a base surface bridging the side surfaces and a holder formed with a complementary trapezoidal-section slot having a pair of side surfaces extending parallel to and longitudinally slidable on the body side surfaces and a base surface bridging the holder side surfaces, extending parallel to the body base surface, spacedly confronting the body base surface, and forming therewith a blade seat. The tongue and groove have widths measured parallel to the base surfaces and transversely of the elongated body that decrease uniformly forward so that the side surfaces converge forward. A blade is gripped between the base surfaces and projecting forward from the body and holder.

15 Claims, 6 Drawing Sheets

DEBURRING KNIFE WITH REPLACEABLE BLADE

FIELD OF THE INVENTION

The present invention relates to a utility knife with a replaceable blade. More particularly this invention concerns a knife used for deburring plastic moldings or castings.

BACKGROUND OF THE INVENTION

A standard deburring knife as described in German patent 3,740,036 of E. Bermann has an elongated body formed with a trapezoidal-section groove having a pair of angled side surfaces extending parallel to the body's longitudinal axis and a base surface bridging the side surfaces and extending at a small acute angle to the axis, and a trapezoidal-section holder shaped to fit in the groove and of uniform cross-sectional shape, that is with angled side surfaces and a flat base surface bridging them. A blade can be gripped between the base surfaces to project forward from the body and holder. This blade is effectively held since as the holder is moved back it wedges the blade between the base surfaces.

Such a knife is relatively simple but has several drawbacks. First of all, the blade is often not held sufficiently tightly, so that it twists or comes loose when in use. Furthermore the holder part can get lost easily.

OBJECTS OF THE INVENTION

It is therefore an object of the present invention to provide an improved utility knife.

Another object is the provision of such an improved utility knife which is particularly usable for deburring and which overcomes the above-given disadvantages, that is which holds its blade very solidly and which cannot come apart in normal use.

SUMMARY OF THE INVENTION

A knife has according to the invention an elongated body having a front end formed with a forwardly projecting trapezoidal-section tongue having a pair of side surfaces and a base surface bridging the side surfaces and a holder formed with a complementary trapezoidal-section slot having a pair of side surfaces extending parallel to and longitudinally slidable on the body side surfaces and a base surface bridging the holder side surfaces, extending parallel to the body base surface, spacedly confronting the body base surface, and forming therewith a blade seat. The tongue and groove have widths measured parallel to the base surfaces and transversely of the elongated body that decrease uniformly forward so that the side surfaces converge forward. A blade is gripped between the base surfaces and projecting forward from the body and holder.

Thus with the holder, which constitutes a slide, is loose when moved forward on the tongue and grips the blade more tightly when moved backward. Thus as the knife blade is pushed into something there is an automatic self-tightening action. Such a structure can exert considerable blade-gripping force, especially when the groove and the tongue have heights that decrease uniformly forward.

According to a further feature of the invention the holder has a formation transversely bridging and closing the groove. This formation is a transverse and outwardly projecting web unitary with the holder and has longitudinally forwardly and rearwardly directed end surfaces. These end surfaces are particularly useful for pushing the holder forward and back for, respectively, loosening or tightening the knife on the blade.

The base surfaces according to this invention can be substantially longer than the blade so that the blade can be retained in a front position held between the base surfaces and projecting forward from the body and a rear position wholly engaged between the base surfaces and not projecting from the body. In this arrangement the holder is formed at its base surface with a throughgoing sight hole through which a blade engaging the holder base surface can be seen. Thus the blade can be handled, pocketed, or shipped safely.

In accordance with a further feature of this invention the holder is formed with a rearwardly projecting arm and the arm and body have complementary interfitting formations permitting only limited relative movement between the holder and the body. The arm formation is an enlarged head and the body formation is a groove in which the arm and its head are longitudinally displaceable and which has a restricted neck portion through which the head cannot pass longitudinally. Thus the holder cannot be separated from the body, but can still move longitudinally on it. This arm is elastically laterally deflectable so that the knife can be assembled easily.

The knife body according to the invention is formed with a transverse abutment at a rear end of the body base surface so that the blade can longitudinally rearwardly engage the abutment when between the base surfaces. In addition each of the base surfaces can be formed with a generally semi-cylindrical central groove. The blade has a generally cylindrical rod engaged in the grooves and includes a flat adapter plate formed with a central seat in which the rod is fitted but otherwise gripped between the base surfaces. The rod has a radially outwardly open groove and the adapter plate has bumps engaging radially inwardly into the rod groove. The rod is loosely received in the surface grooves so that the rod can rotate in the knife. The body is formed with a transverse abutment at a rear end of the body base surface and the adapter plate has a rear end engaging the abutment and a front end generally flush with a front end of the tongue.

BRIEF DESCRIPTION OF THE DRAWING

The above and other objects, features, and advantages will become more readily apparent from the following description, reference being made to the accompanying drawing in which.

SPECIFIC DESCRIPTION

Figure 2:
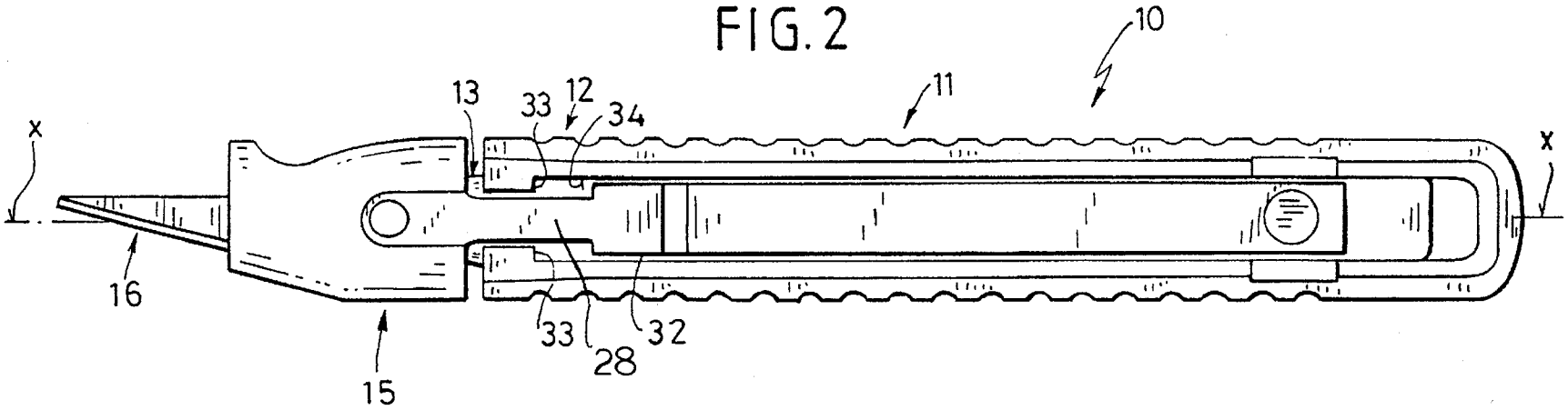
FIG. 2 is a bottom view of the knife.
Figure 1:
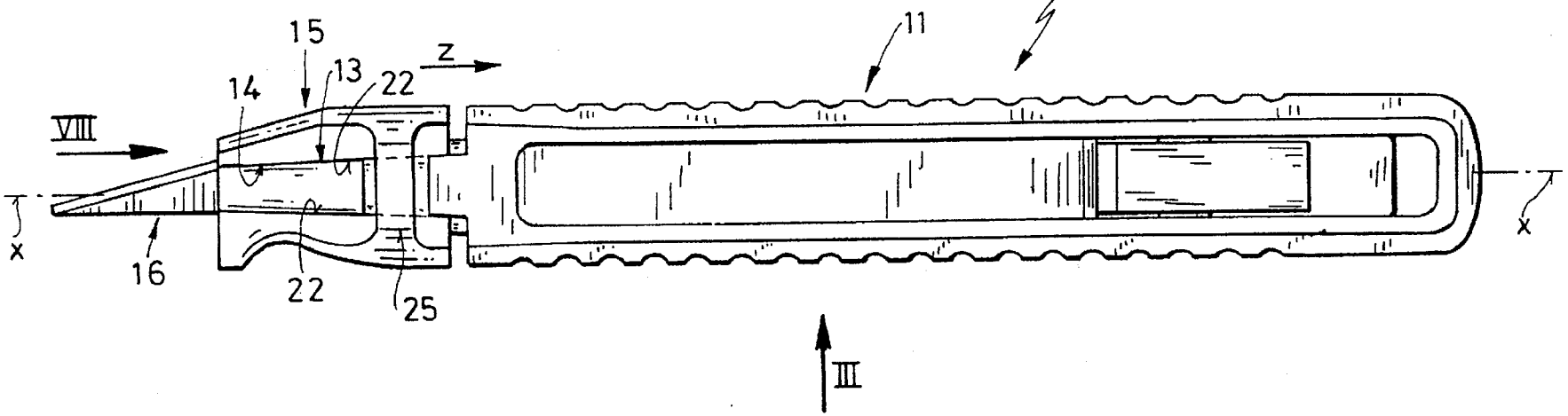
FIG. 1 is a top view of the knife according to the invention.
Figure 3:
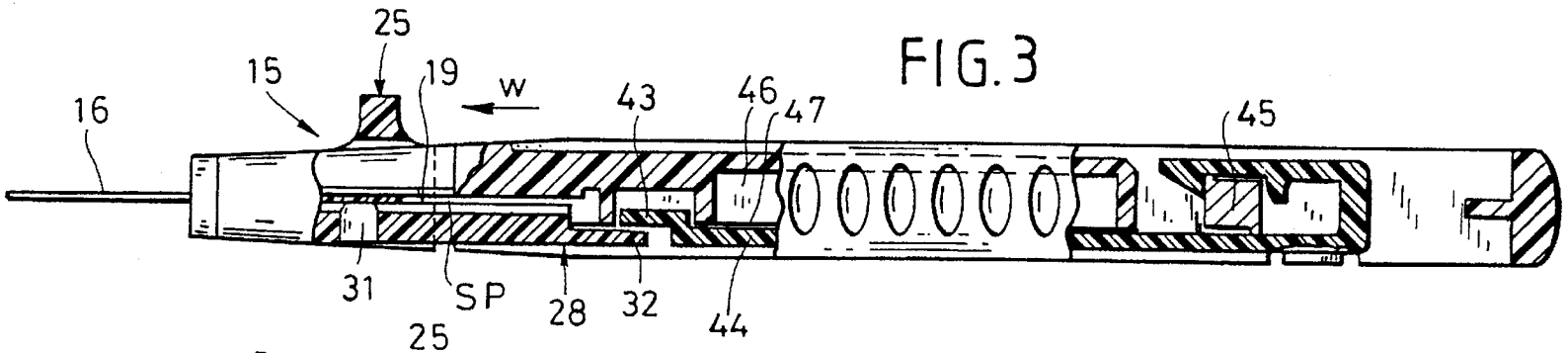
FIG. 3 is a partly sectional view of the knife in the direction of arrow III of FIG. 1.
Figure 4:
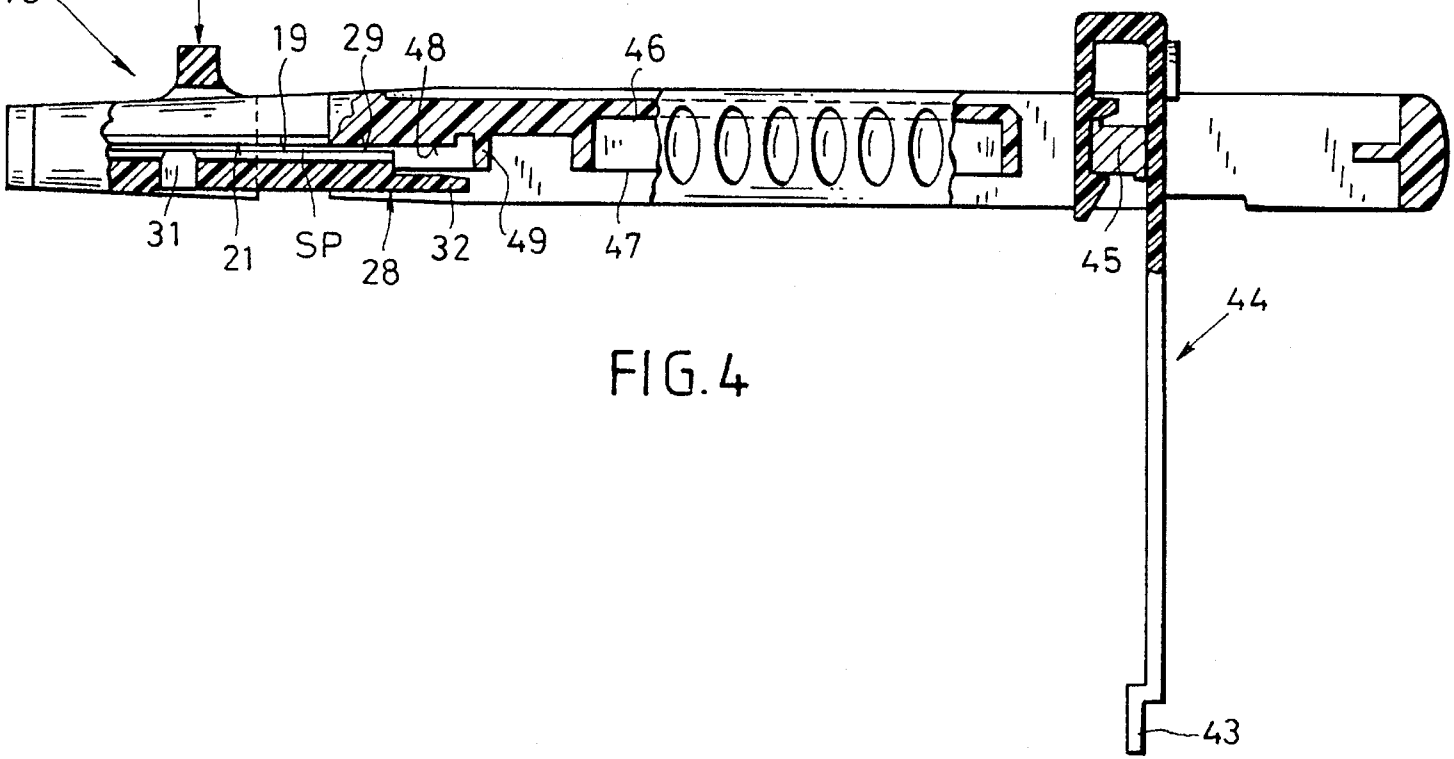
FIG. 4 is a view like FIG. 3 but showing the knife with the blade-storage compartment open and the blade-holding slide in the forward release position.
Figure 5:
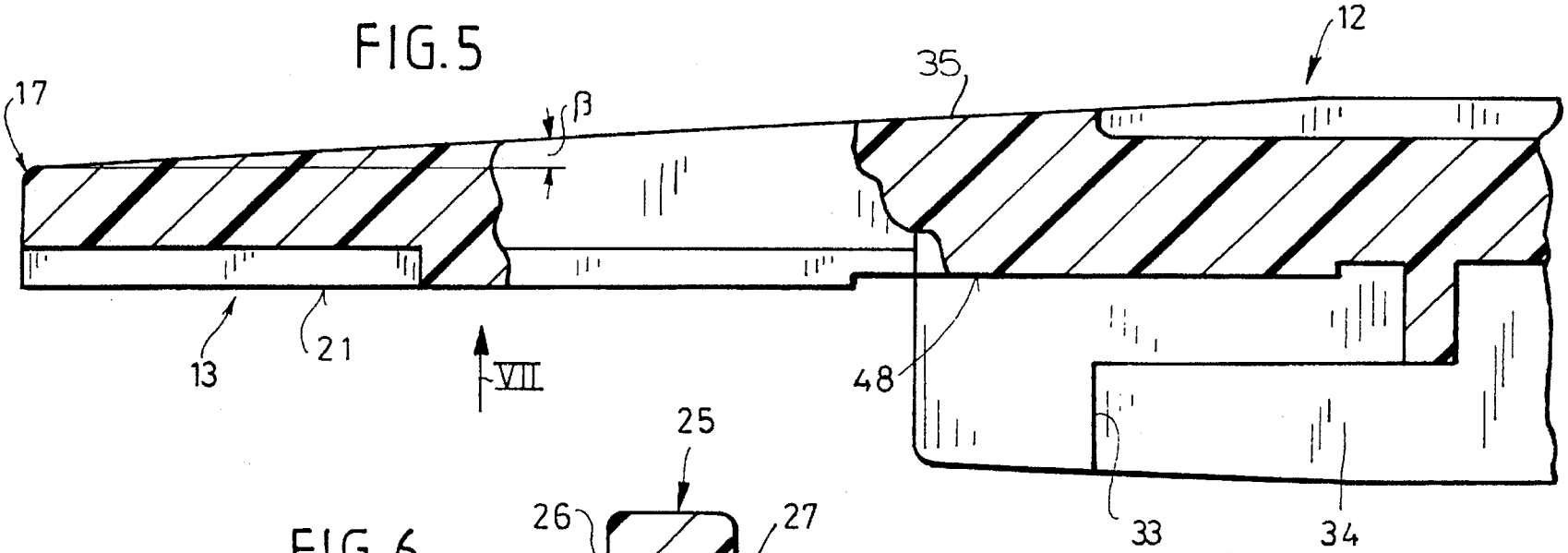
FIG. 5 is a large-scale longitudinal section through the front part of the body of the knife.
Figure 6:
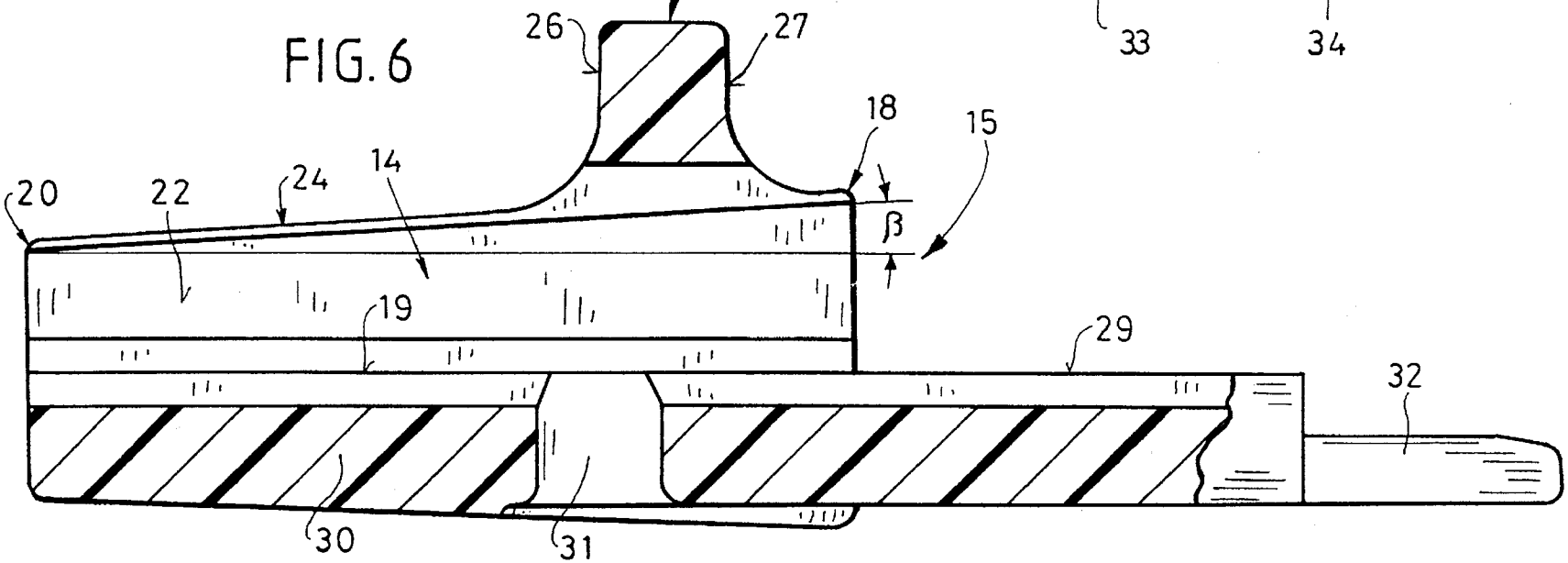
FIG. 6 is a large-scale longitudinal section through the blade-holding slide.
Figure 7:
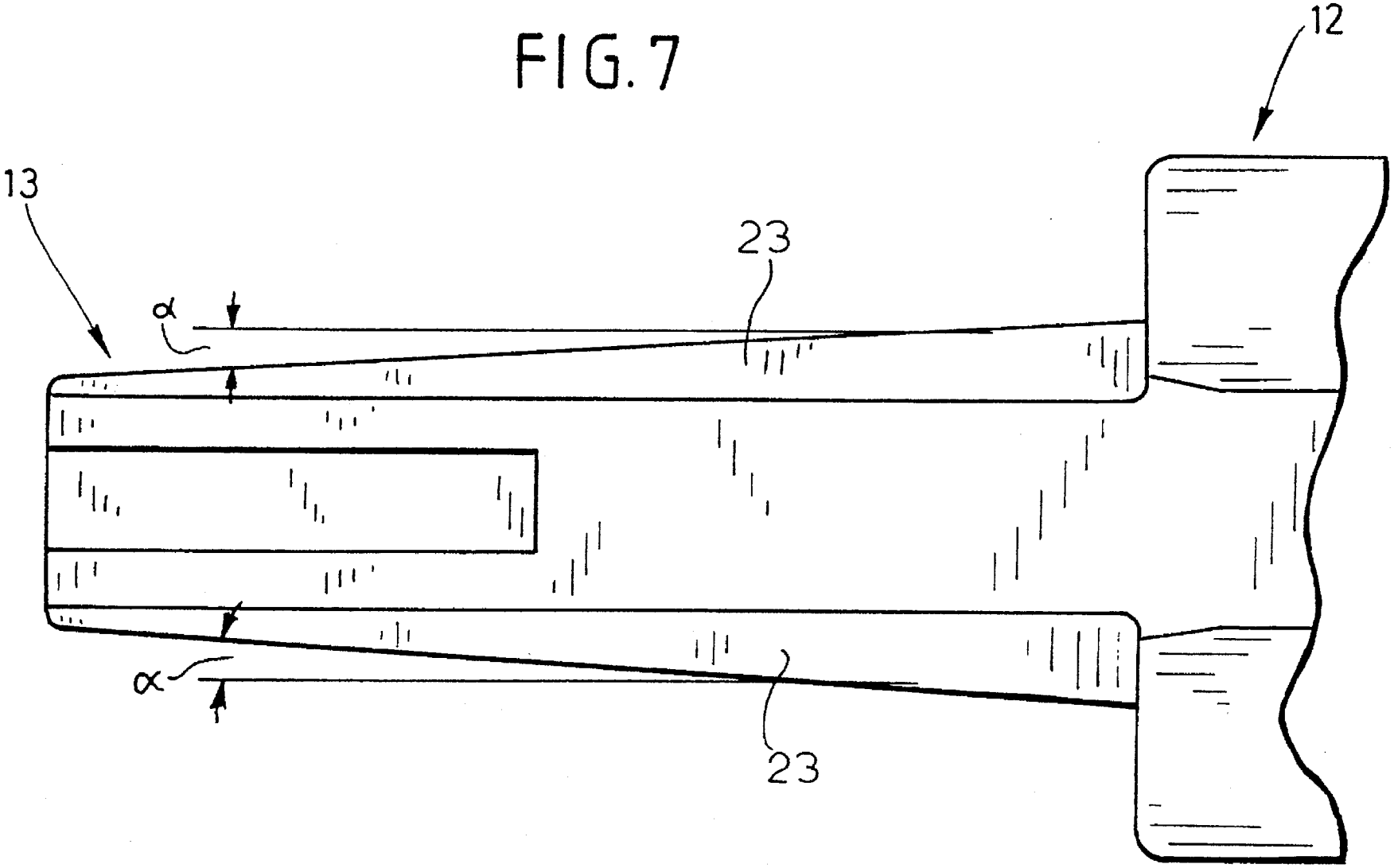
FIG. 7 is a view taken in the direction of arrow VII of FIG. 5 of the front part of the knife body.

As seen in FIGS. 1 through 4 a deburring knife 1 has a handle-forming body 11 with a front grip region 12 from which forwardly projects a trapezoidal-section mounting tongue 13. A blade-mounting slide 15 formed with a complementary trapezoidal-section groove 14 fits over this tongue 13 and clamps a flat blade 16 against it. FIGS. 5 through 7 show how the tongue 13 tapers toward its front end 17 and the groove 14 complementarily flares backward from its front end 20 to its rear end 18. A base surface 19 of the groove 14 extends parallel to a base surface 21 of the tongue and both side faces 22 of the groove extend parallel to the respective side faces 23 of the tongue 13. The groove 14 has a width BN and a height HN as shown in FIG. 8 that corresponds to a width BF and a height HF of the tongue 13.

Figure 8:
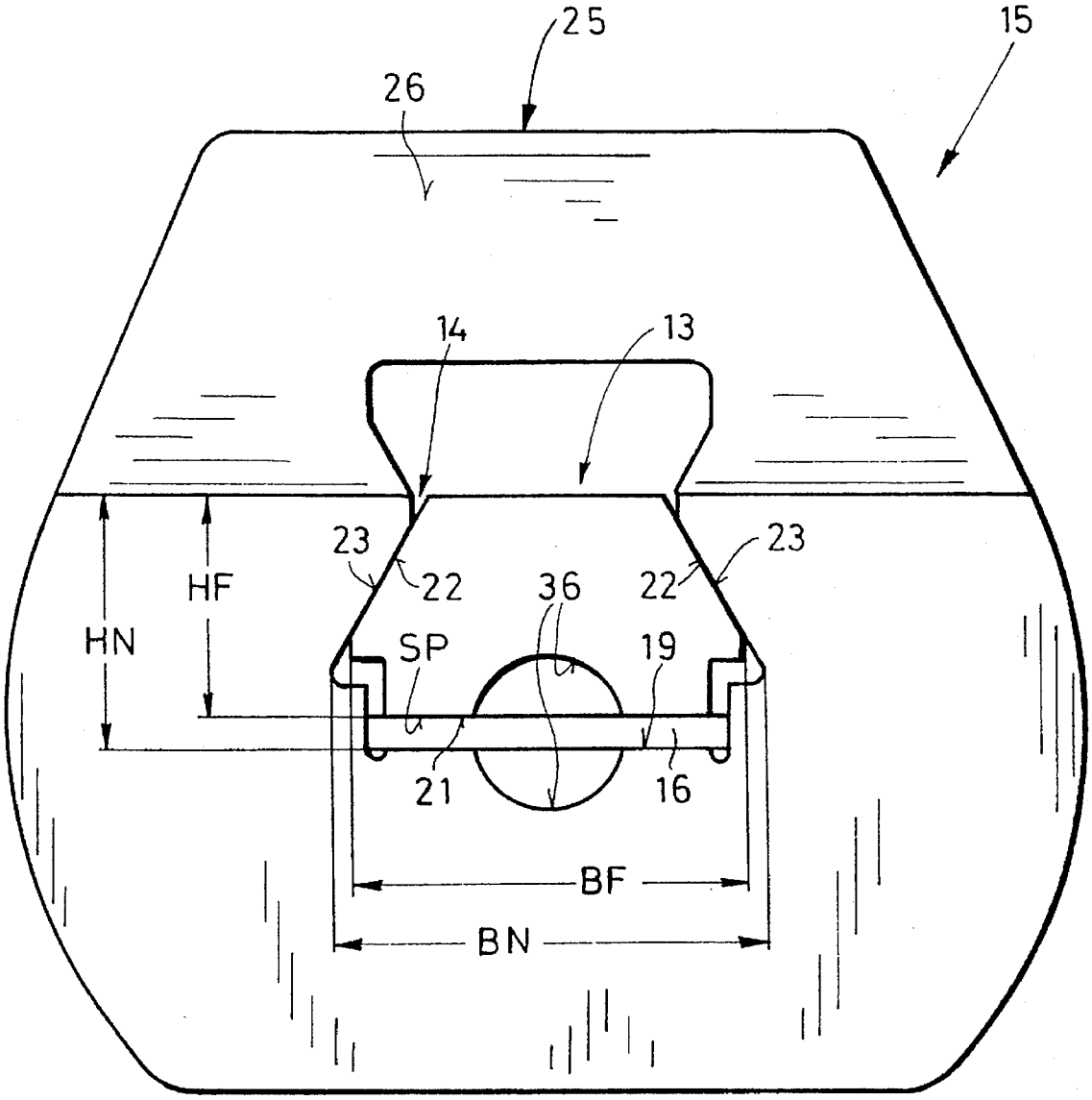
FIG. 8 is an enlarged front end view taken in the direction of arrow VIII of FIG. 1.
Figure 9:
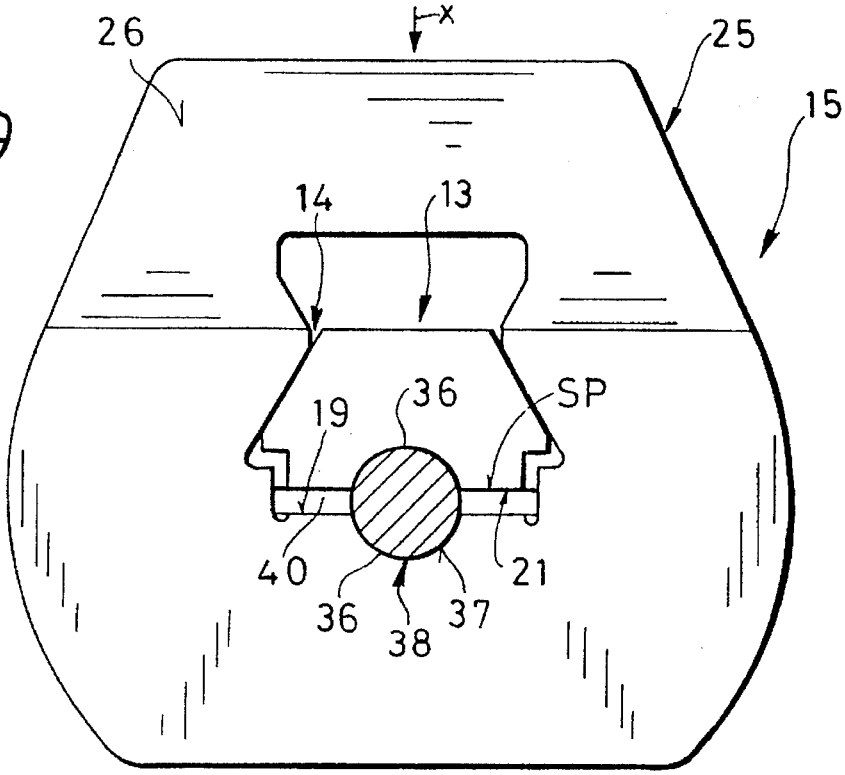
FIG. 9 is a view like FIG. 8, but to slightly smaller scale, showing the system in use with a rod-mounted blade.
Figure 10:
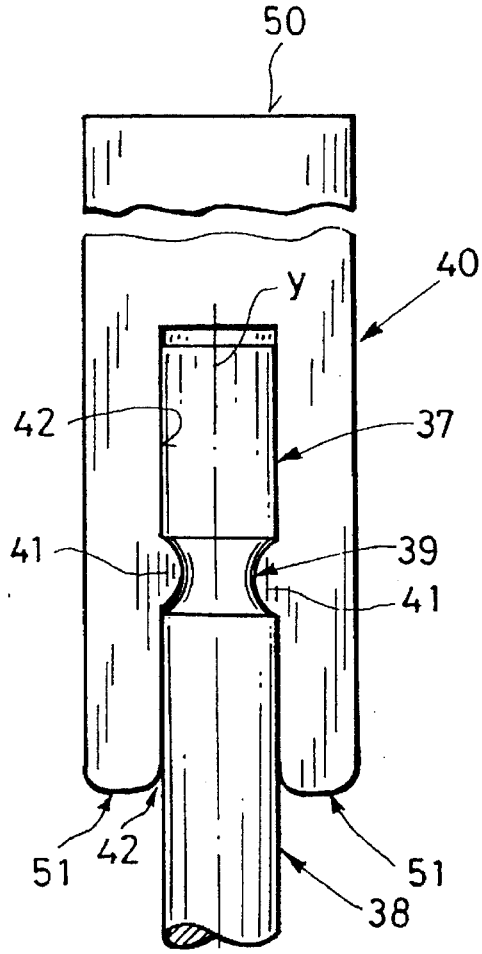
FIG. 10 is a top view of the rear end of a rod-mounted blade.

Thus the tongue 13 and groove 14 together form a blade-holding slot or seat SP basically defined between the two parallel surfaces 19 and 21 as best seen in FIGS. 8 and 9. The groove width BN and tongue width BF decrease continuously to the front ends 20 and 17 to produce an excellent clamping effect on the blade 16, with the side faces 23 and 22 tapering at an angle (FIG. 7) to the longitudinal axis x of the knife. Similarly the groove height HN and tongue height HF decrease to the free ends 20 and 17 as indicated by the taper angle β shown in FIGS. 5 and 6 along an upper surface 35 of the tongue 13.

In order to prevent sides 24 of the holder 15 from spreading when the tongue 13 is forced into the groove 14, the tongue 15 is formed with a crosswise web 25 bridging the groove 14 and having front and rear faces 26 and 27 that are useful for pushing this part 15 onto and off the body 11. In addition the two base surfaces 19 and 21 are much longer than the part of the blade 16 they grip when the tip of the blade 16 is projecting from the front of the knife 10. This extra length of the surfaces 19 and 21 and the seat SP formed by them makes it possible for the blade 16 to be pushed fully back into a rear region 48 of the slot SP, against a web 49, so that the blade 16 does not project from the knife 19 and it can be shipped or pocketed safely. An aperture or window 31 in a lower wall 30 of the holder 15 allows the user to see in to determine if there is a blade 16 present in the slot SP.

The holder 15 has a rearwardly projecting arm 28 that extends through a slot 29 in the body 11 and that has at its rear end an enlarged head 32 riding in an enlarged guide slot 34 of the body 11. This head 32 can forwardly engage abutment shoulders 33 of the body 11 in an extreme forward position of the holder 15 so that it prevents the holder 15 from being pulled completely off the body 11.

FIGS. 8 and 9 show how the surfaces 19 and 21 are each centrally formed with a semicircular cutout 36 adapted to accommodate a cylindrical rod 37 of a rod-type deburring blade 38 of the type described in German utility model 8,618,646. This blade 38 is formed with an outwardly open circumferential groove 39 and is held by a holder plate 40 having a slot 42 adapted to fit over the rod 37 and formed with bumps 41 that engage in the groove 39. Thus even though this plate 40 will be clamped tightly in the groove 14, the rod blade 38 will be able to rotate about its axis y. The adapter plate 50 is longer than a standard flat blade 16 so its rear end 50 can abut the web 49 to allow the rod blade 38 to be used for poking. When this end 50 is against the web 49 a front end 51 of the plate 40 is flush with the front end 17 of the tongue 13.

The body 11 forms a spare-blade compartment 46 having a rim 47 that is normally covered by a flap 44 pivotal on a rear transverse pin 45 of the body 11 and having a front end 43 that is captured under the rear end 32 of the holder 15 in the rear holding position thereof. Thus when the holder 15 is moved forward into the FIG. 3 position it is possible to pivot out the flap 44 and expose the compartment 46 for access to a spare blade held therein.

I claim:

1. A knife comprising:

an elongated body having a front end formed with a forwardly projecting trapezoidal-section tongue having a pair of side surfaces and a base surface bridging the side surfaces;

a holder formed with a complementary trapezoidal section slot having a pair of side surfaces extending parallel to and longitudinally slidable on the body side surfaces and a base surface bridging the holder side surfaces, extending parallel to the body base surface, spacedly confronting the body base surface, and forming therewith a blade seat, the tongue and groove having widths measured parallel to the base surfaces and transversely of the elongated body that decrease uniformly forward, whereby the side surfaces converge forward; and a blade gripped between the base surfaces and projecting forward from the body and holder.

2. The knife defined in claim 1 wherein the groove and the tongue have heights that decrease uniformly forward.

3. The knife defined in claim 1 wherein the holder has a formation transversely bridging and closing the groove.

4. The knife defined in claim 3 wherein the formation is a transverse and outwardly projecting web unitary with the holder.

5. The knife defined in claim 4 wherein the web has longitudinally forwardly and rearwardly directed end surfaces.

6. The knife defined in claim 1 wherein the base surfaces are substantially longer than the blade, whereby the blade can be retained in a front position held between the base surfaces and projecting forward from the body and a rear position wholly engaged between the base surfaces and not projecting from the body.

7. The knife defined in claim 6 wherein the holder is formed at its base surface with a throughgoing sight hole through which a blade engaging the holder base surface can be seen.

8. The knife defined in claim 1 wherein the holder is formed with a rearwardly projecting arm and the arm and body have complementary interfitting formations permitting only limited relative movement between the holder and the body.

9. The knife defined in claim 8 wherein the arm formation is an enlarged head and the body formation is a groove in which the arm and its head are longitudinally displaceable and which has a restricted neck portion through which the head cannot pass longitudinally.

10. The knife defined in claim 1 wherein the holder is formed with a rearwardly projecting arm along which the holder base surface extends.

11. The knife defined in claim 1 wherein the body is formed with a transverse abutment at a rear end of the body base surface, whereby the blade can longitudinally rearwardly engage the abutment when between the base surfaces.

12. The knife defined in claim 1 wherein each of the base surfaces is formed with a generally semicylindrical central groove, the blade having a generally cylindrical rod engaged in the grooves.

13. The knife defined in claim 12 wherein the blade includes a flat adapter plate formed with a central seat in which the rod is fitted but otherwise gripped between the base surfaces.

14. The knife defined in claim 13 wherein the rod has a radially outwardly open groove and the adapter plate has bumps engaging radially inwardly into the rod groove, the rod being loosely received in the surface grooves, whereby the rod can rotate in the knife.

15. The knife defined in claim 14 wherein the body is formed with a transverse abutment at a rear end of the body base surface, the adapter plate having a rear end engaging the abutment and a front end generally flush with a front end of the tongue.

* * * * *